US008262191B2

(12) United States Patent
Mori

(10) Patent No.: US 8,262,191 B2
(45) Date of Patent: Sep. 11, 2012

(54) PRINTING APPARATUS AND PRINTING METHOD

(75) Inventor: Tatsuya Mori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 12/817,240

(22) Filed: Jun. 17, 2010

(65) Prior Publication Data

US 2010/0321431 A1 Dec. 23, 2010

(30) Foreign Application Priority Data

Jun. 23, 2009 (JP) ..... 2009-148830

(51) Int. Cl.
*B41J 29/393* (2006.01)

(52) U.S. Cl. ..... 347/19; 347/23

(58) Field of Classification Search ..... 347/23, 347/19

See application file for complete search history.

(56) References Cited

U.S. PATENT DOCUMENTS 6,527,358 B2 3/2003 Kuriyama et al.
2007/0229578 A1* 10/2007 Yokozawa et al. ..... 347/23
2007/0229591 A1* 10/2007 Konno ..... 347/40

FOREIGN PATENT DOCUMENTS

JP 3382526 B2 12/2002
JP 2007-290352 A 11/2007

* cited by examiner

*Primary Examiner* — Julian Huffman
(74) *Attorney, Agent, or Firm* — Fitzpatrick, Cella, Harper & Scinto

(57) ABSTRACT

A printing apparatus and a printing method in which an ejection failure state sensing process is sufficiently carried out while a decrease in printing throughput to be suppressed are provided. The print head includes at least two ejection ports through which different amounts of ink in the same color are ejected; both ejection amounts are equal to or smaller than 5 pl. The printing apparatus carries out a first ejection failure state sensing process for sensing a first ejection ports which have the smallest opening area in the ejection ports formed in the print head. The printing apparatus also carries out a second ejection failure state sensing process for sensing an ejection state in which ink is ejected through all the ejection ports in the print head. When any ejection port is determined to be in an inappropriate ejection state, the printing apparatus carries out compensation printing.

8 Claims, 12 Drawing Sheets

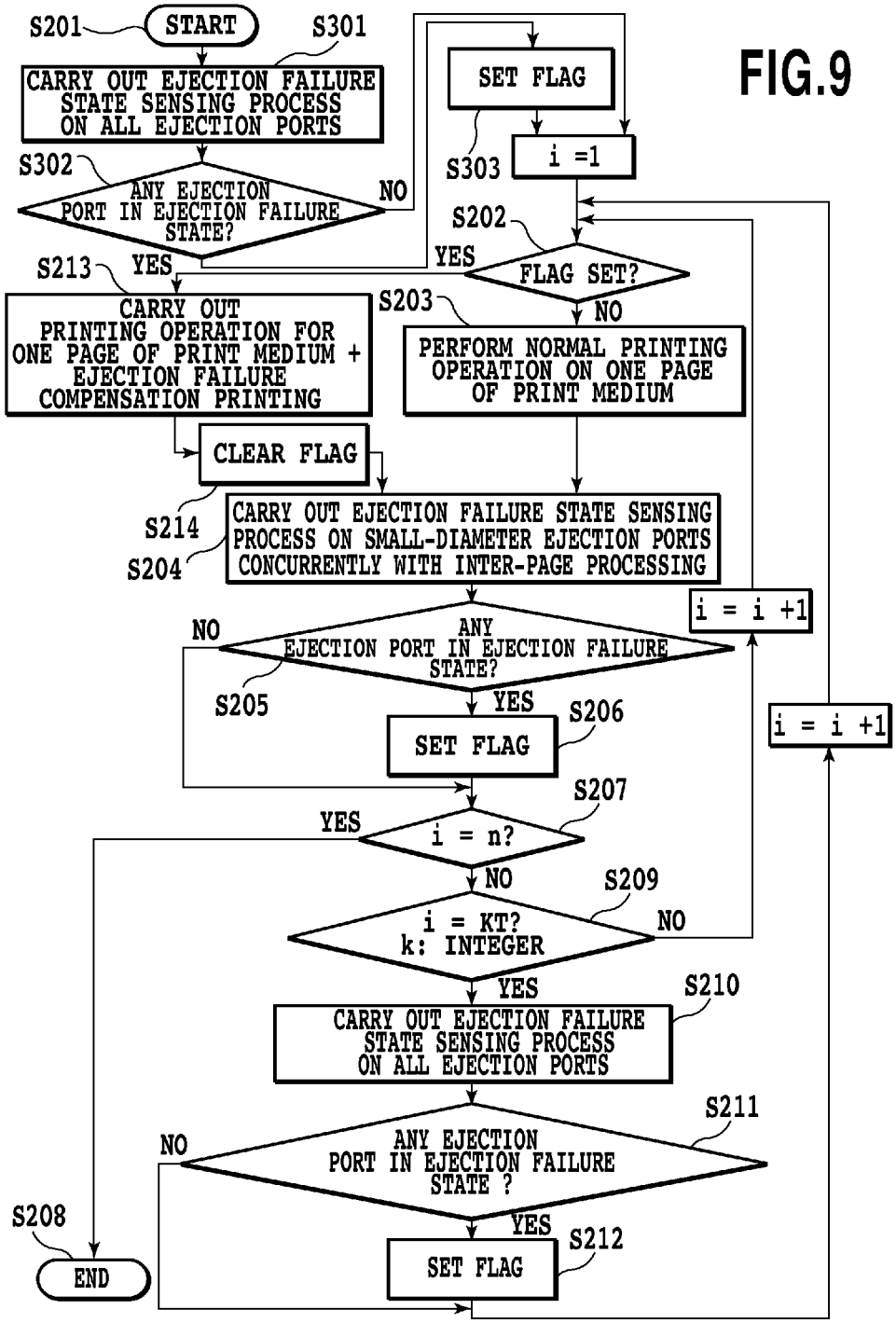
FIG.9
S201
START
S301
CARRY OUT EJECTION FAILURE STATE SENSING PROCESS ON ALL EJECTION PORTS
S302
ANY EJECTION PORT IN EJECTION FAILURE STATE?
NO
YES
S213
CARRY OUT PRINTING OPERATION FOR ONE PAGE OF PRINT MEDIUM + EJECTION FAILURE COMPENSATION PRINTING
CLEAR FLAG
S214
SET FLAG
S303
i =1
S202
FLAG SET?
YES
NO
S203
PERFORM NORMAL PRINTING OPERATION ON ONE PAGE OF PRINT MEDIUM
S204
CARRY OUT EJECTION FAILURE STATE SENSING PROCESS ON SMALL-DIAMETER EJECTION PORTS CONCURRENTLY WITH INTER-PAGE PROCESSING
i = i +1
S205
ANY EJECTION PORT IN EJECTION FAILURE STATE?
NO
YES
S206
SET FLAG
i = i +1
S207
i = n?
YES
NO
S209
i = KT?
k: INTEGER
NO
YES
S210
CARRY OUT EJECTION FAILURE STATE SENSING PROCESS ON ALL EJECTION PORTS
S211
ANY EJECTION PORT IN EJECTION FAILURE STATE ?
NO
YES
S212
SET FLAG
S208
END

PRINTING APPARATUS AND PRINTING METHOD

BACKGROUND OF THE INVENTION

1. Field of the Invention

The present invention relates to a printing apparatus and a printing method in which a print medium is printed by allowing a print head to eject ink, and in particular, to a printing apparatus and a printing method which involve sensing of the condition in which ink is ejected through ejection ports.

2. Description of the Related Art

In recent years, ink jet printing apparatuses have been prevailing rapidly, wherein printing is performed by allowing a print head to eject ink droplets onto a print medium. Many ink jet printing apparatus adopt an ink droplet ejection method in which ink is heated to cause film boiling so that the resulting pressure allows ink droplets to fly as an ink droplets ejection method. Unlike an electrophotographic scheme, this method requires no intermediate transfer unit and thus needs few intervening elements in forming images. Hence, the method has the advantage of allowing intended images to be stably obtained.

On the other hand, in the ink jet printing apparatus, inappropriate ink ejections may result from, for example, blockage of ejection ports by dust or thickened ink or coverage of ejection ports with ink droplets. Such an inappropriate ink ejection may be an ejection failure state in which no ink droplets are ejected from ejection ports, a state in which ink droplets are ejected but in which an ejection speed is lower than a predetermined value, resulting in a failure to impact print media, or deviation of impact positions of ejected ink droplets. When such an inappropriate ink ejection is occurred, particularly in an ink jet printing apparatus with a small number of passes, corresponding defective portions concentrate in particular areas of print images. Thus, there are some cases that white or black stripes are generated.

The ink jet printing apparatus with a small number of passes is used by the printing apparatus to perform printing relatively large-sized print media mainly, for example, used for commercial applications such as printing of posters and POP advertisements and industrial applications. Thus, to prevent the above-described image defects (white or black stripes), some printing apparatuses configured to print relatively large-sized print media perform what is called ejection failure compensation printing in which an ejection port located adjacent to an ejection port with an inappropriate ejections is used to carry out compensation printing. Therefore, even when the ejection failure state is detected, forming of high quality image printing is kept.

A technique using a light emission element and a light reception element is known as means for sensing the occurrence position of the ink ejection failure state for the ejection failure compensation printing. In a method for sensing the ink ejection failure state using this sensing means, the light emission element and the light reception element are positioned such that ink droplets pass between these elements. Thus, when ink is ejected, a change in the quantity of light passing between these elements is sensed. In this manner, the occurrence position of the ejection failure state is sensed by sequentially detecting, for each ejection port, whether or not light emitted by the light emission element is blocked by ink droplets.

In the sensing of the ejection failure state, the ejection failure state can be found earlier by increasing the frequency of sensing operations. Then, ejection ports in the ejection failure state can be compensated for. However, since the process of sensing is carried out individually on the respective ejection ports, particularly if the printing apparatus includes a large number of ejection ports like those configured to print large-sized print media as described above, printing needs to be halted for a long time. Thus, when the sensing of the ejection failure state is excessively frequently carried out, the time for which printing is suspended for the sensing of the ejection failure state increases unnecessarily. This may reduce printing throughput.

In view of the above-described circumstances, in order to carry out a process of sensing the ejection failure state at a frequency such that a decrease in throughput is minimized, while maintaining as high image quality as possible, Japanese Patent Laid-Open No. 2007-290352 discloses a method of adjusting the frequency of the ejection failure state sensing process with the accumulated number of ejections focused on. In Japanese Patent Laid-Open No. 2007-290352, the number of ink ejections is counted from the last ejection failure state sensing process. Then, when the ejection number exceeds a predetermined value, the next ejection failure state sensing process is carried out.

By the way, in recent years, even for printing apparatuses configured to print large-sized print media, there has been a demand for high-definition images of a photographic image quality level. For consumer use, ink jet printing apparatuses that use very small droplets have already been provided as instruments that print images with photographic image quality. Such ink jet printing apparatuses configured to print images with the photographic image quality generally eject at most 5 pl of droplets. The amount of the smallest droplets ejected in some recent ink jet printing apparatuses with such a configuration is smaller than 1 pl. The printing apparatus configured to eject very small droplets also includes ejection nozzles allowing formation of dots each corresponding to several dots of the smallest droplets to compensate lowered speed of printing generated by decrease in amount of droplets. Hence, recent ink jet printing apparatuses with the photographic image quality each include a plurality of ejection ports configured to eject different amounts of droplets in which both amounts are equal to or smaller than 5 pl.

The present inventors developed a printing apparatus configured to print large-sized print media and including a plurality of ejection ports configured to eject different amounts of droplets in which both amounts are equal to or smaller than 5 pl. However, the present inventors found that an ejection failure state not observed in the conventional art occurred in this printing apparatus. Furthermore, this new ejection failure state occurred much more frequently than those recognized in the conventional art. Thus, when an attempt is made to compensate for the ejection failure state with the conventional design concept unchanged, achieving both high image quality and a high throughput is very difficult.

SUMMARY OF THE INVENTION

Thus, in view of the above-described circumstances, an object of the present invention is to provide a printing apparatus and a printing method in which when an ink jet printing apparatus configured to perform ejection failure compensation printing is used for high-definition printing, the present invention allows, based on a new concept, a decrease in printing throughput to be suppressed while enabling the ejection failure state to be inhibited from occurring in ejection ports in a print head.

According to a first aspect of the present invention, there is provided a printing apparatus configured such that a print head comprising at least two ejection ports through which different amounts of ink in the same color is ejected, both ejection amounts being equal to or smaller than 5 pl, is mounted, the print head ejecting ink for printing through the ejection ports, wherein the printing apparatus comprises: an ejection failure state sensing unit for carrying out a first ejection failure state sensing process for sensing an ejection state of ink ejected through first ejection ports which have the smallest opening area in the ejection ports formed in the print head and for carrying out a second ejection failure state sensing process for sensing an ejection state of ink ejected through all the ejection ports in the print head, the second ejection failure state sensing process is carried out less frequently than the first ejection failure state sensing process, and wherein when any ejection port is determined to be in an inappropriate ejection state by the first ejection state sensing process or the second ejection state sensing process, compensation printing is carried out so as to compensate for a dot to be formed by the ejection port in the inappropriate ejection state using a different ejection port for printing with compensation.

According to a second aspect of the present invention, there is provided a printing method of performing printing using a printing apparatus configured to perform printing by allowing a print head including at least two ejection ports to eject different amounts of ink in the same color through the ejection ports, both ejection amounts being equal to or smaller than 5 pl, wherein the printing method comprises: a first ejection failure state sensing step of sensing an ejection state of ink ejected through first ejection ports which have the smallest opening area in the ejection ports formed in the print head; and a second ejection failure state sensing step of sensing an ejection state of ink ejected through all the ejection ports in the print head, the second ejection failure state sensing step is carried out less frequently than the first ejection failure state sensing step, and wherein when any ejection port is determined to be in an inappropriate ejection state by the first ejection state sensing step or the second ejection state sensing step, compensation printing step is carried out so as to compensate for a dot to be formed by the ejection port in the inappropriate ejection state using a different ejection port.

According to the present invention, if different frequencies of the ejection failure state result from printing with the use of a print head including at least two ejection ports through which different amounts of ink in the same color are ejected and in which both ejection amounts are small, the process of sensing the ejection failure state can be carried out in accordance with the likelihood of occurrence of the ejection failure state. Thus, the present invention minimizes the time for which printing is suspended by the ejection failure state sensing process with detecting the ejection failure state reliably, in accordance with the likelihood of occurrence of the ejection failure state. This allows a decrease in throughput to be minimized. The present invention can thus provide a printing apparatus and a printing method in which high-speed printing can be carried out with the quality of print images kept high.

Further features of the present invention will become apparent from the following description of exemplary embodiments (with reference to the attached drawings).

BRIEF DESCRIPTION OF THE DRAWINGS

FIG. 9 is a flowchart showing control steps for a printing operation and the ejection failure state sensing process carried out by the printing apparatus in FIG. 1;

DESCRIPTION OF THE EMBODIMENTS

Embodiments for carrying out the present invention will be described below with reference to the drawings.

First Embodiment

An ink jet printing apparatus according to a first embodiment of the present invention will be described. The ink jet printing apparatus according to the present embodiment is assumed to be used to print relatively large-sized print media, for example, used for commercial applications such as printing of posters and POP advertisements and industrial applications. Thus, an ink jet printing apparatus configured to print roll paper will be described.

Figure 1:
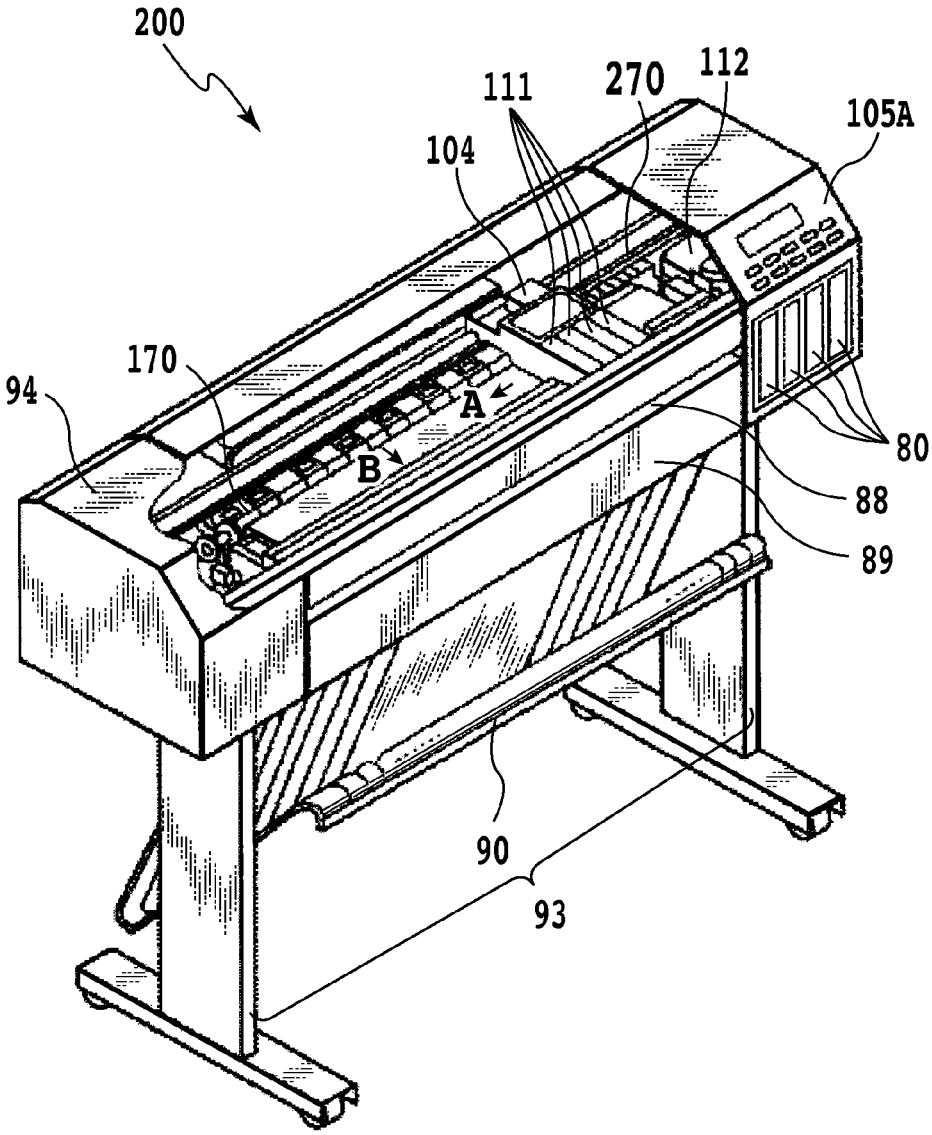
FIG. 1 is a perspective view showing the appearance of a printing apparatus according to a first embodiment of the present invention.

FIG. 1 is a perspective view of an ink jet printing apparatus (hereinafter also simply referred to as a printing apparatus) 200 which is partly exploded so as to show the internal structure. FIG. 1 shows the ink jet printing apparatus 200 with an upper cover removed therefrom.

As shown in FIG. 1, a manual insertion port 88 is formed in the front surface of the printing apparatus 200. A roll paper cassette 89 that can be opened forward is provided under the manual insertion port 88 shown in FIG. 1. Cut paper with a fixed length can be inserted through the manual insertion port 88. Print media such as print paper are fed into the printing apparatus through the manual insertion port 88 or the roll paper cassette 89. The printing apparatus 200 includes an apparatus main body 94 supported by two leg portions 93 and a stacker 90 on which discharged print media are stored. Furthermore, an operation panel 105A, a ejection failure state sensing unit 112, and an ink tank 80 are disposed on the right side of an apparatus main body 94 in FIG. 1.

As shown in FIG. 1, the printing apparatus 200 includes a conveying roller 170 configured to convey print media such as print paper in the direction of an arrow B (sub-scanning direction). Moreover, the printing apparatus 200 includes a carriage unit (hereinafter referred to as a carriage) 104 supported and guided so as to be reciprocatable in the width direction of a print medium (in the direction of arrow A; a main scanning direction). Furthermore, the printing apparatus includes a carriage motor (not shown in the drawings) and a carriage belt (hereinafter referred to as a belt) 270 configured so as to reciprocate the carriage 104 in the direction of arrow A. In the printing apparatus 200 according to the present embodiment, a relatively large space serving as a conveyance path for print media is formed so as to enable relatively large-sized print media to be printed. In the printing apparatus 200 according to the present embodiment, an ink jet print head (hereinafter referred to as a print head) 111 can be mounted in the carriage 104. That is, the print head 111 carries out printing by ejecting droplets through ejection ports while scanning is performed in the direction crossing the direction in which the print medium is conveyed. Furthermore, a photosensor unit configured to sense a paper position is installed in the carriage 104. The printing apparatus further includes an ink tank 80 from which ink is fed to the print head 111 and an ejection failure state sensing unit 112 configured to sense that the print head 111 fails to eject ink.

Figure 2:
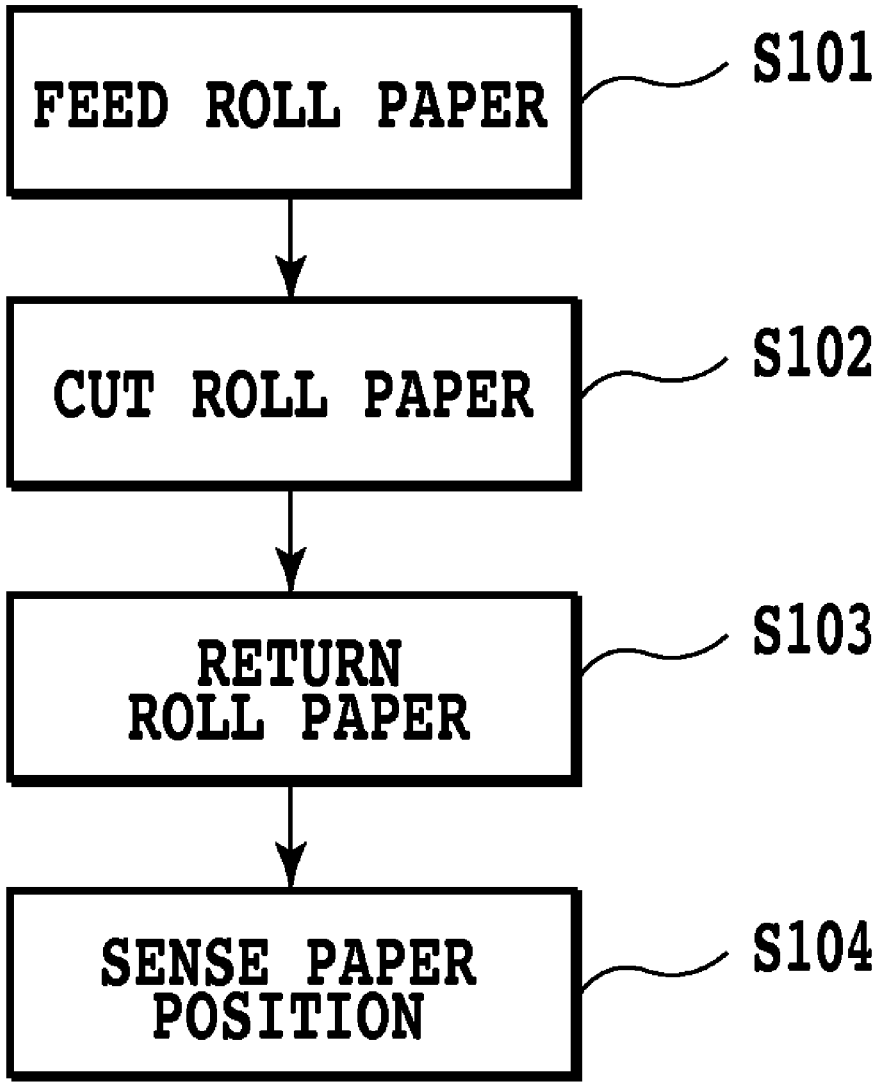
FIG. 2 is a flowchart showing a process from the end of printing of one page until the placement of the next print medium at a print position which process is executed when the printing apparatus in FIG. 1 is used to perform continuous printing.

If the roll paper cassette 89 is used to continuously print on roll paper, such a process as shown in FIG. 2 is executed between the end of printing of one page and the start of printing of the next page. In the present embodiment, a roll paper feeding process S101, a roll paper cutting process S102, a roll paper returning process S103, a paper position sensing process S104, and the like are carried out between each printing onto each page. In the roll paper feeding process S101, to be cut at the end of the page at which printing is finished, roll paper is fed such that the end of the roll paper is positioned at a cut position corresponding to a cutter. Furthermore, in the roll paper return process S103, the roll paper is returned such that before printing of the next page is started, the end of the roll paper has been placed at a print position for printing on the next page. In the paper position sensing process S104, the photosensor unit is used to sense the paper position to determine whether or not the paper is misaligned.

Figure 3:
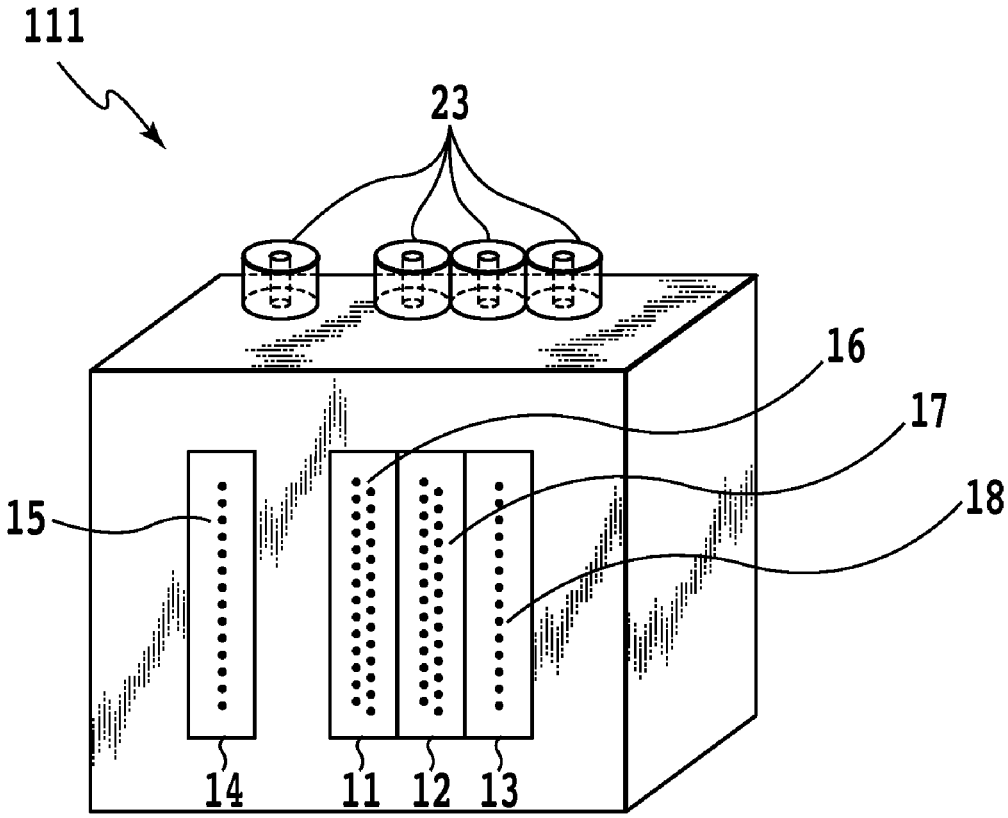
FIG. 3 is an enlarged perspective view showing a print head mounted in the printing apparatus in FIG. 1.
Figure 4:
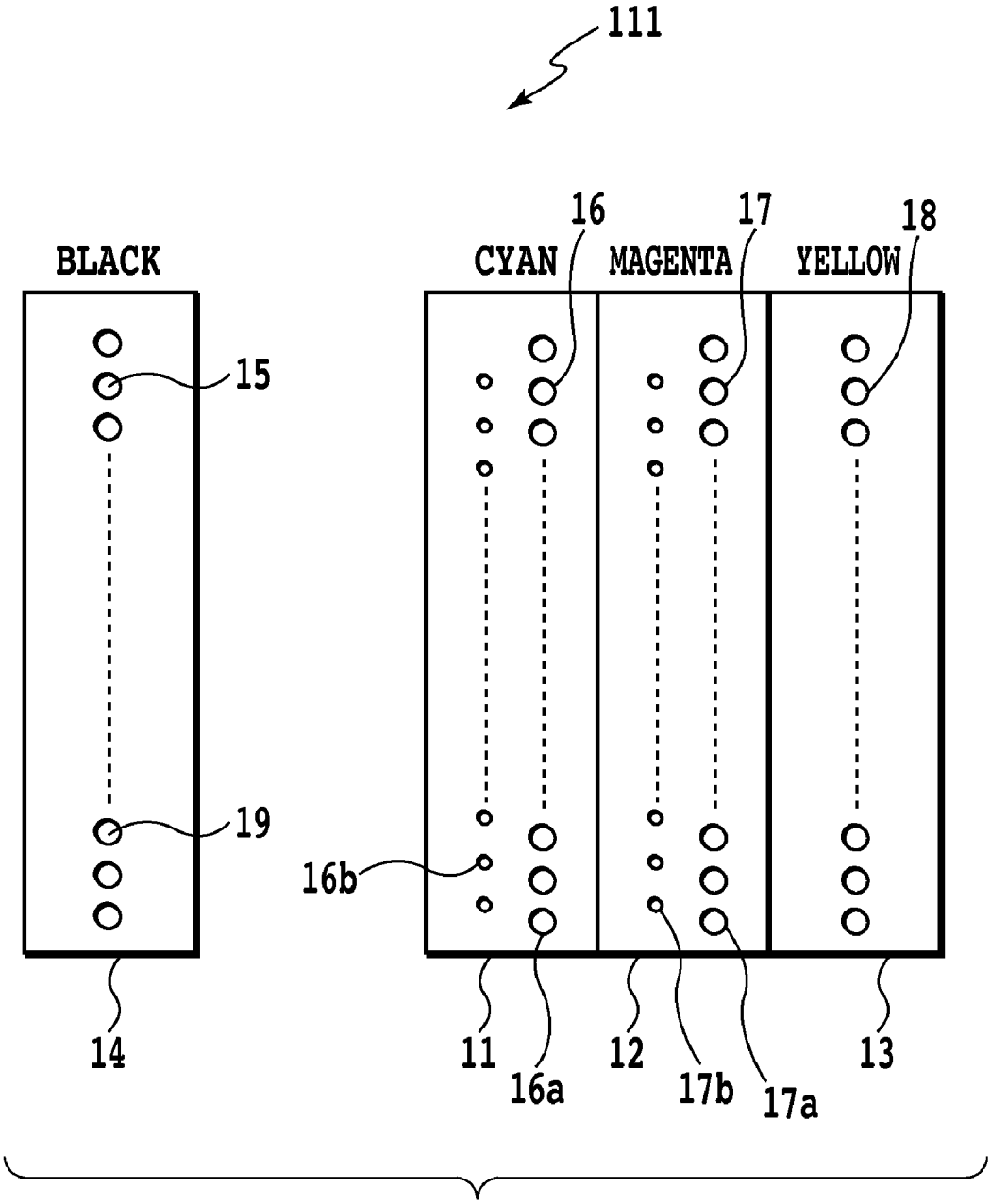
FIG. 4 is an enlarged plan view showing an ejection port surface of the print head in FIG. 3 in which surface ejection ports are formed.

FIG. 3 is a perspective view of the appearance of the print head 111 mounted in the carriage 104. FIG. 4 is an enlarged plan view of the periphery of an ejection port in an ejection port formation surface of the print head 111 shown in FIG. 3 as viewed from the side from which ink is ejected.

As shown in FIG. 3, the print head 111 includes a black print head 14 configured to eject black ink and including a plurality of ejection ports 15 arranged therein and through which black ink is ejected. The print head 111 also includes a cyan print head 11, a magenta head 12, and a yellow head 13 configured to eject cyan ink, magenta ink, and yellow ink, respectively, and including ejection ports 16, 17, and 18 arranged therein and through which cyan ink, magenta ink, and yellow ink, respectively, are ejected.

As shown in FIG. 4, the ejection port rows through which the black ink, cyan ink, magenta ink, and yellow ink, respectively, are ejected are formed in the print head 111 in the ink jet printing apparatus according to the present embodiment. Thus, the print head 111 can eject droplets in a plurality of colors. One ejection port row is formed for each of the black ink and the yellow ink. Two ejection port rows are formed for each of the cyan ink and the magenta ink. Furthermore, in the set of two ejection port rows through which each of the cyan color and the magenta color is ejected, the ejection ports in one of the ejection port rows are staggered with respect to the ejection ports in the other ejection port row by half a pitch.

In the ejection port row through which each of the black ink and the yellow ink is ejected, 256 ejection ports 15, 18 are arranged at an arrangement density such that about 245 ejection ports 15, 18 are arranged per 1 cm. The ejection port row through which each of the black ink and the yellow ink is ejected is formed of the ejection ports 15 or 18 through which 5 pl of ink is ejected.

Furthermore, in the ejection port row through which each of the cyan ink and the magenta ink is ejected, 512 ejection ports 16, 17 are arranged at an arrangement density such that about 490 ejection ports 16, 17 are arranged per 1 cm. The ejection ports 16 through which the cyan ink is ejected include a row formed of ejection ports 16*a* through which 5 pl of ink is ejected and a row formed of ejection ports 16*b* through which 1 pl of ink is ejected. The ejection ports 17 through which the magenta ink is ejected include a row formed of ejection ports 17*a* through which 5 pl of ink is ejected and a row formed of ejection ports 17*b* through which 1 pl of ink is ejected. That is, of a total of 1,024 cyan ejection ports, 512 ejection ports each include 1-pl nozzle. Of a total of 1,024 magenta ejection ports, 512 ejection ports each include 1-pl nozzle. As described above, the plurality of ejection ports 19 in the print head 111 include ejection ports with a relatively small opening area and an ejection amount of 1 pl (first ejection ports) and ejection ports having a larger opening area than the first ejection ports and having an ejection amount of 5 pl (second ejection ports). Thus, the printing apparatus according to the present embodiment is configured as described above, thus enabling printing of photographic quality, for example, printing of photographs and posters. The reason why no ejection port with an ejection amount of 1 pl is formed in the ejection port rows through which yellow ink and black ink are ejected is as follows.

For yellow, the difference in ejection amount is difficult to perceive by human beings. Black is infrequently used for tonal expression.

Of course, if the relationship with the printing speed is not very important, ejection ports with an ejection amount of 1 pl may be provided for these ink colors.

In two-way printing in which the print head 111 carries out printing in both a forward scanning direction and a backward scanning direction, the color impression may vary depending on the moving direction of the carriage owing to the order of impacts and the adverse effect of air flows. Thus, the print head 111 is difficult to use for two-way printing and is thus often used for one-way printing. However, the present invention is not limited to applications to one-way printing but may be applied to printing apparatuses configured to carry out two-way printing.

Four print heads 11 to 14 configured to eject ink in the respective colors are supplied with ink in the corresponding colors through supply ports 23. The supply ports 23 are coupled to respective plural ink tanks in which different types of ink (black, yellow, magenta, and cyan) are accommodated. To compensate for consumption of ink, the supply ports 23 allow new ink to be uninterruptedly supplied to ejection ports 19 through which the ink has been ejected or sucked.

Figure 5:
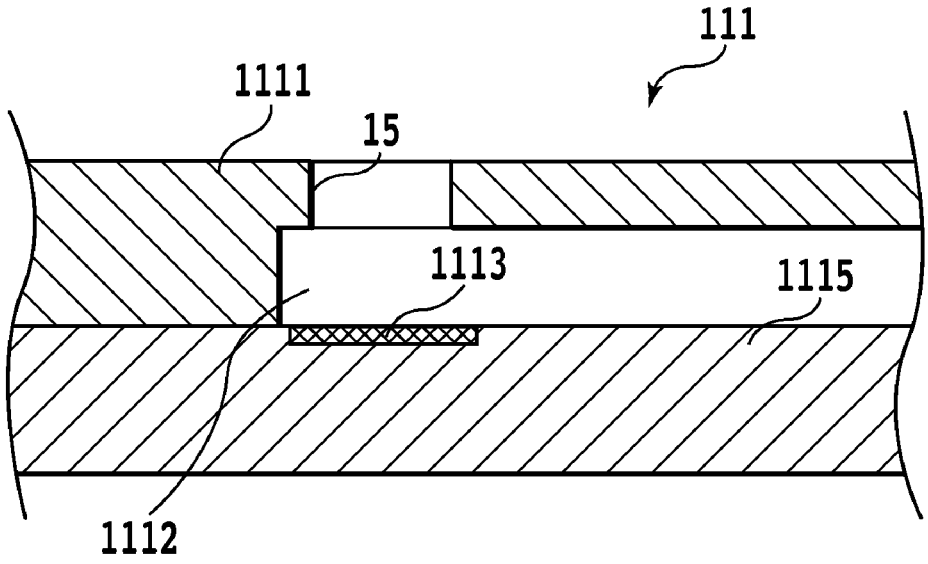
FIG. 5 is an enlarged sectional view showing the periphery of the ejection port in the print head in FIG. 3.

FIG. 5 is a schematic sectional view of the periphery of the ejection port 19 in the print head 111 viewed from lateral side. As shown in FIG. 5, a rectangular heater 1113 serving as an electrothermal conversion element is provided at a predetermined position on an element substrate 1115. An orifice plate 1111 is disposed on the heater 1113. The orifice plate 1111 includes the ejection port 15 that is open at a position corresponding to a central portion of the heater 1113. The print head 111 allows the heater 1113 serving as an electrothermal conversion element to convert electric energy into heat energy so that the heat energy allows bubbles to be generated in the ink in a bubbling chamber 1112. The resulting bubbling pressure allows ink droplets to be ejected through the ejection port 15.

Now, an ejection failure compensation method according to the present embodiment will be described.

Figure 6:
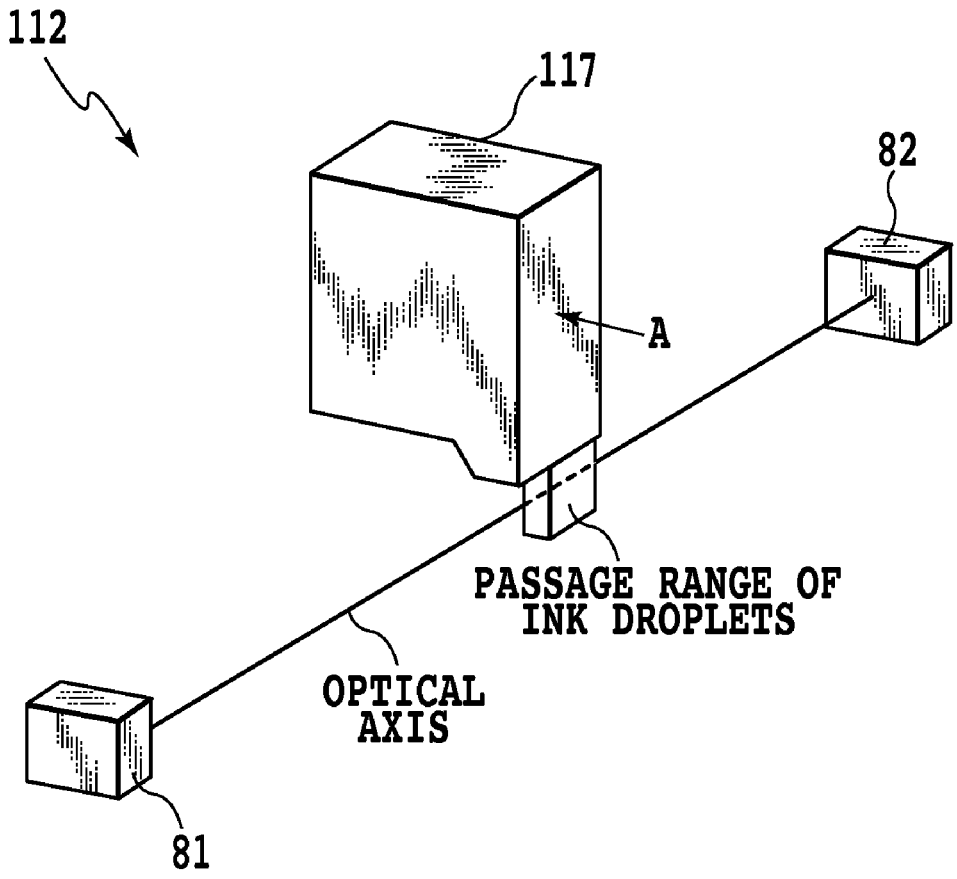
FIG. 6 is a schematic perspective view showing a ejection failure state sensing unit used when the printing apparatus in FIG. 1 carries out the ejection failure state sensing process.

First, the configuration of an ejection failure state sensing unit configured to carry out the ejection failure state sensing process will be described. FIG. 6 shows the arrangement of the ejection failure state sensing unit 112 and the print head 111. The ejection failure state sensing unit 112 includes a light emission element 81 and a light reception element 82. When ink droplets are ejected from the print head 111, light from the light emission element 81 is blocked to reduce the quantity of light reaching the light reception element 82. The ink droplet ejection failure state sensing section detects the decrease in light quantity to sense the ink ejection failure state. A voltage corresponding to the detected light quantity (ink ejection amount) can be obtained from the light reception element 82. The voltage is then compared with a predetermined voltage value Vref using a comparator 83, to sense the ink ejection failure state (photo interrupter scheme). When a small amount of ink droplets are ejected, a small quantity of light is blocked, making the sensing difficult. Furthermore, it is empirically known that in the ejection failure state sensing process, the ejection failure state can be sufficiently sensed by carrying out eight ejections through each ejection port. Additionally, the amount of time corresponding to 40 ejections per ejection port is required for the comparison using the comparator 83.

When the ejection failure state sensing unit 112 configured as described above carries out the ejection failure state sensing process, the ejection failure state sensing process for the plurality of ejection ports 19 present on an optical axis can be accomplished through one alignment operation. Thus, in a print head in which ejection ports are arranged in a plurality of rows, provided that the positional relationship is adjusted such that the each ejection port row is placed on the optical axis, the sensing process can be carried out on all the ejection ports by moving the print head a number of times corresponding to the number of rows.

Ejection failure compensation printing is carried out for ejection ports determined by the above-described ejection failure state sensing process to be in the ejection failure state. The reason is as follows. If any ejection port is in the ejection failure state, the corresponding pixel on printed matter is missing. Thus, when printing is continued with no appropriate measures taken, the resulting image may be blurred or the characters may be difficult to read. Here, the ejection failure state refers to the state in which no ink droplet is ejected though the ejection ports during printing for any reason. In the present embodiment, the ejection failure sensing means senses the state in which no ink droplet is ejected though the ejection ports. However, the ejection failure sensing means may sense any other inappropriate ink ejection state. Such an inappropriate ink ejection state may be, for example, deviation of impact positions resulting from an insufficient ejection speed or blurred printing resulting from insufficient refilling.

Any of the following three methods may be used for the ejection failure compensation printing, that is, a printing method for compensating for the ejection port in the ejection failure state, through which no ink droplets are ejected.

In a first method (adjacent ejection-port compensation), if any ejection port is in the ejection failure state, the dot to be ejected through the ejection port is distributed to ejection ports located at the both of the adjacent ejection ports in the ejection failure state. In another method (different-color compensation), if any cyan ejection port is in the ejection failure state, for example, an ink dot in another color is used to compensate for the data corresponding to the cyan ejection port in the ejection failure state. In yet another method, in a divisive printing scheme in which printing is performed by allowing the print head to carry out a plurality of scans, a portion in the ejection failure state is compensated for by other normal ejection ports. The present invention may adopt any of the ejection failure compensation schemes. The present embodiment will be described mainly in conjunction with an example of adjacent ejection-port compensation. However, ejection failure compensation printing used for the present invention may include not only an ejection failure compensation scheme described above but also ejection failure compensation printing based on a scheme other than those described above.

Now, a specific method for the ejection failure state sensing process, an essential part of the present invention, will be described.

Firstly, a detailed description will be given of an ejection failure phenomenon that occurred in a printing apparatus configured to print large-sized print media and to offer photographic image quality, that is, including a plurality of ejection ports through which different amounts of ink are ejected and in which the different amounts are equal to or smaller than 5 pl.

The ejection failure phenomenon exhibited two characteristics.

First, the frequency of occurrence of the ejection failure phenomenon is one digit higher than that conventionally recognized.

Second, the phenomenon has failed to occur in conventional, similarly configured printing apparatuses for consumer use.

In particular, adverse effects related to the frequency are critical. If the ejection failure sensing process is carried out in accordance with the frequency as in the conventional art, printing needs to be halted for a significantly long time in total. Furthermore, for faster printing, the ink jet printing apparatus configured to print large print media and including differently sized ejection ports has a much larger number of ejection ports than in the conventional art. Thus, the ejection failure sensing process results in the need for a longer printing halt time than in the conventional art.

Thus, there has been a demand for a new method and a new printing apparatus which enable ejection failure compensation printing in spite of the above-described frequently-occurring ejection failure state, without affecting an expected high-speed printing capability.

The present inventors further studied the frequently-occurring ejection failure state. Then, the present inventors found that the ejection failure state occurs only in the smaller ones of the plurality of ejection ports through which the different amounts of ink are ejected and in which both the ejection amounts are equal to or smaller than 5 pl.

This discovery has led the present inventors to the present invention for the first time.

Because, in the conventional art, for some time after the printer has started to be used, the ejection failure state occurs very infrequently. Moreover, there is not so great a difference in occurrence frequency between the large and small ejection ports both of which have an ejection amount of equal to or more than 5 pl. Thus, the ejection failure state sensing process is normally carried out evenly on all the ejection ports in the print head at given intervals in the conventional printing apparatus.

Hence, in the above-described environment, the ejection failure sensing process inevitably requires a significantly long time, thus enhancing the tradeoff relationship between the throughput and the maintenance of image quality.

However, the present inventors have found for the first time that the occurrence frequency of the ejection failure state in particular ejection ports is extremely different from that in the other ejection ports. Thus, the present inventors have successfully reduced the time required for the frequently executed ejection port sensing process by making the frequency of the ejection failure sensing process executed on the particular ejection ports different from that of the ejection failure sensing process executed on the other ejection ports.

Thus, the tradeoff relationship between the throughput and the maintenance of image quality has been corrected.

When it is considered that the above-described conventionally-unexpected ejection failure state occurred only in the small ejection ports and did not occur in conventional consumer use, it is predicted that the new ejection failure state is caused by a combination of the following factors.

That is, the factors causing the ejection failure state include structural factors and use environment factors.

One of the structural factors is a decrease in a margin for the maintenance of ejection characteristics caused by an increase in resistance of ink moving forward associated with very small ejection ports.

The use environment factors as the other structural factor is structure of the likelihood that the ejection ports are likely to become hotter than in the conventional art and the environment in which the ejection ports are used at high temperature (this environment is hereinafter simply referred to as the high-temperature environment).

First, the decrease in the margin for the maintenance of the ejection characteristics caused by the increase in resistance of ink moving forward will be described. The flow resistance in the front of the bubbling chamber increases with decreasing ejection port opening area as the square of the opening area. Thus, for small-diameter ejection ports with high resistance of ink moving forward, bubbling power is set to be higher than in the conventional art to keep the ejection state in balance. On the other hand, the increased bubbling power escapes toward the rear of the bubbling chamber, which offers relatively low flow resistance. This is expected to significantly reduce the margin for maintaining the appropriate ejection state. This tendency is observed in structures with an ejection amount of about equal to or larger than 2 pl. Thus, when the environment in the bubbling chamber changes, for example, bubbles are generated in the bubbling chamber, the bubbling power is prevented from being sufficiently transmitted to the ejection port side. As a result, possibility that droplets are prevented from being ejected is generated potentially.

Now, the high-temperature environment will be described.

In general, when the temperature of the print head increases, bubbles may be likely to be generated in the bubbling chamber. This is because gas dissolved in the ink is segregated in a high-temperature environment. The segregated dissolved gas is normally discharged during ejection or quickly re-dissolved into the ink while printing is halted. Thus, the gas poses no problem.

However, in printing of large print media, for example, printing of posters for industrial applications, when the printing operation is halted before one print medium is completely printed, the ejection state changes slightly in the corresponding portion of the print medium. Furthermore, the color impression changes in that portion of the print medium. Thus, it is not preferable to halt the printing operation before at least one print medium is completely printed. Then, continuous printing time increases inevitably depending on the size of the print media. Thus, the heaters are continuously driven for a long time in order to allow in droplets to be consecutively ejected. Hence, the temperature of the print head is likely to increase. This also increases the time intervals at which a recovery process such as preliminary ejection is carried out for every predetermined number of print media.

Moreover, if the printing apparatus is used for an industrial application, the printing speed is emphasized. Thus, the interval between the end of printing of one print medium and the start of printing of the next print medium is frequently set to be relatively short. Even when bubbles are generated inside the bubbling chamber, if a long interval is provided between the end of printing of one print medium and the start of printing of the next print medium, the bubbles often contract and disappear during the interval. However, in the industrial printing apparatus, the bubbles may be prevented from contracting and disappearing between the end of printing of one print medium and the start of printing of the next print medium. As a result, the bubbles may remain inside the bubbling chamber.

Furthermore, where the ejection ports are arranged at a high integration density, heat is difficult to diffuse or radiate. Additionally, when the entire surface of the print medium is continuously printed with a small number of passes by the print head, ejection is consecutively carried out at high frequency. The heaters are consecutively driven. Thus, heat is difficult to radiate from the heaters and is prone to build up in the print head. Hence, the temperature of the print head as a whole is likely to increase. In particular, the temperature is more likely to increase around a central portion of the print head from which only a small quantity of heat is radiated.

This indicates that in the above-described high-temperature environment, bubbles are likely to be segregated in the bubbling chamber.

Therefore, it is expected that in the environment in which the ejection failure state is potentially likely to occur, the ejection failure state in this case occurred when the head was driven in a thermally harsh condition.

A specific ejection failure compensation method according to the present embodiment will be described.

In the present embodiment, while a printing operation is being performed, an ejection failure state sensing process is carried out on the ejection ports 15 formed in the print head at a predetermined timing. In the present embodiment, two types of ejection state sensing processes, a first ejection failure state sensing process 7B and a second ejection state sensing process 7A are carried out on the ejection ports 15. The first ejection failure state sensing process 7B of sensing only the small ejection ports 16*b* and 17*b* which are included in the ejection ports 19 on the print head and which have a relatively small opening area is carried out a plurality of times in parallel with an inter-page process. In the first ejection failure state sensing process 7B, the ejection failure state is sensed within 5 seconds. Furthermore, besides the first ejection failure state sensing process 7B, the second ejection failure state sensing process 7A is carried out on all the ejection ports 19 on the print head. The ejection failure state sensing process of sensing all the ejection ports 19 has been found to require about 15 seconds.

Here, the inter-page process refers to steps included in the inter-page process in FIG. 2 and carried out between feeding and returning of roll paper. During this operation, no printing operation is performed. Thus, the carriage 104 need not move and stands by at the home position ordinarily. In the present embodiment, this standby time is utilized to carry out the first ejection failure state sensing process 7B only on the ejection ports in the print head 111. In this manner, the present embodiment includes the ejection state sensing process (first ejection state sensing step) of sensing the ejection state of ejected droplets for the ejection ports having relatively small opening area. In particular, the present embodiment includes the ejection state sensing process of sensing the ejection state of ejected droplets for the ejection ports having relatively small diameter. The present embodiment also includes the ejection state sensing process (second ejection state sensing step) of sensing the ejection state of ejected droplets for all the ejection ports.

Adoption of these ejection state sensing processes allow the ejection failure compensation process to maintain high image quality while minimizing a decrease in throughput.

Figure 7A:
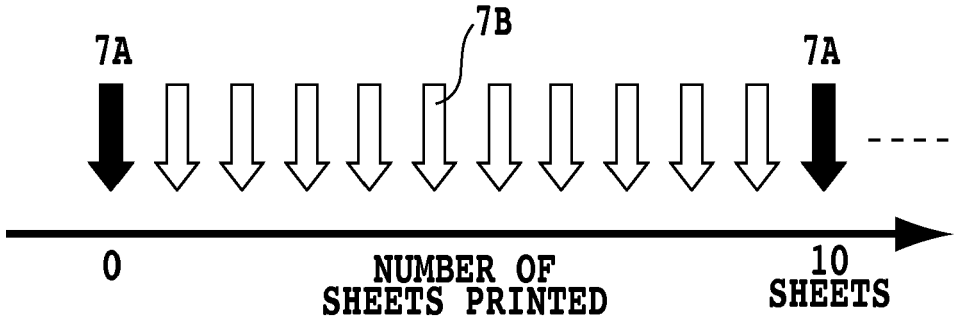
FIG. 7A is a diagram illustrating timings when the ejection failure state sensing process is carried out by the printing apparatus according to a first embodiment of the present invention.
Figure 7B:
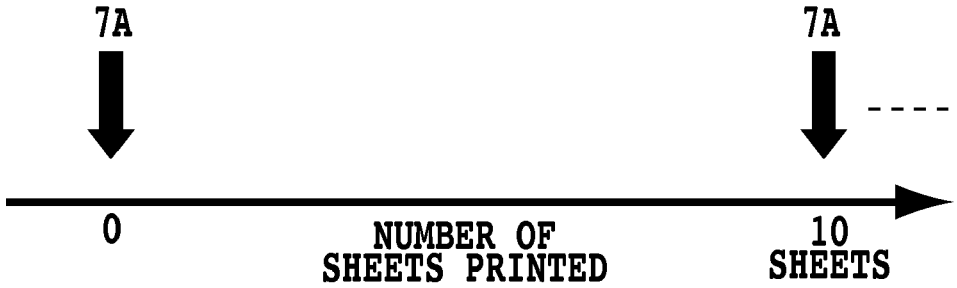
FIG. 7B is a diagram illustrating timings when the ejection failure state sensing process is carried out in a comparative example.

Now, with reference to FIGS. 7A and 7B, a comparison will be made between the timings when the ejection failure state sensing process according to the present embodiment is carried out and the timings when the conventional ejection failure state sensing process is carried out. In the conventional art, as shown in FIG. 7B, once the predetermined intervals at which the ejection failure state sensing process for all the ejection ports is carried out are set, the ejection failure state sensing process is not particularly carried out at timings other than the predetermined ones. In contrast, in the present embodiment, as shown in FIG. 7A, the second ejection failure state sensing process 7A is carried out for every ten print media. In addition, the first ejection failure state sensing process 7B for the relatively-small-diameter ejection ports is carried out for every page.

Compared to the comparative example (FIG. 7B) in which the conventional ejection failure state sensing process 7A for all the ejection ports is carried out for every ten print media, the present embodiment can increase the frequency of the sensing process by 10-fold for the small-diameter ejection ports while suppressing a decrease in throughput.

The above-described ejection failure compensation printing is suitable for industrial applications in which relatively large-sized print media are printed as in the case of the printing apparatus according to the present embodiment. When the ejection failure compensation printing is performed, even if any ejection port is determined to be in the ejection failure state, the ink ejection from the ejection port in the ejection failure state can be compensated for without the need to suspend the printing. Thus, when large-sized print media are printed, even if any ejection port is determined to be in the ejection failure state during printing of one print medium, the printing can be continued without being suspended. If any ejection port is determined to be in the ejection failure state during printing of one print medium, when a recovery process is carried out on the ejection port, the printing is temporarily suspended in order to allow the recovery process to be carried out. If the printing is suspended in order to allow the recovery process or the like to be carried out on the ejection port in the ejection failure state, the color impression observed before the interruption may be different from those observed after the interruption. When the color impression is changed during printing of one print medium, the quality of the print image may be degraded. In contrast, in the printing apparatus according to the present embodiment, even if any ejection port is determined to be in the ejection failure state during printing of one print medium, a print area covered by the ejection port can be compensated for by the ejection failure compensation process. This eliminates the need to suspend the printing. Thus, the color impression can be prevented from being changed by the suspension of printing of one print medium. This enables the quality of print images obtained by the printing to be kept high. Thus, if relatively large-sized print media are printed, the ejection failure compensation printing is desirably carried out on ejection ports in the ejection failure state so as to prevent the quality of print images from being degraded.

Figure 8:
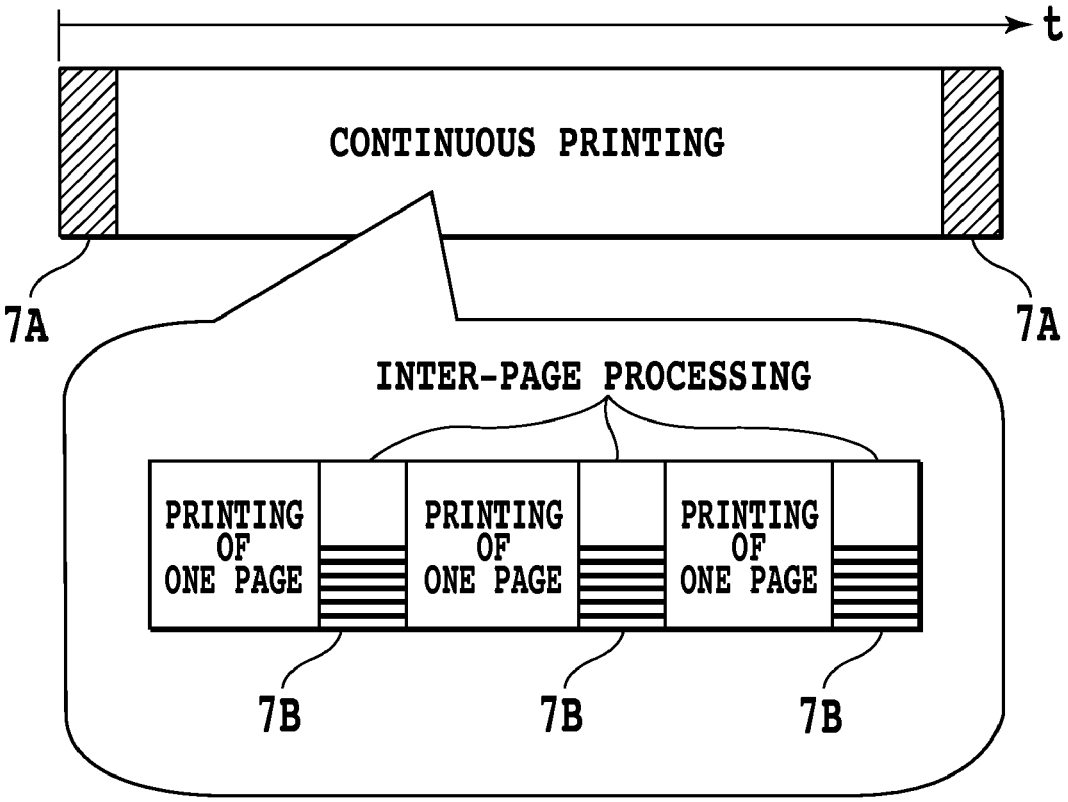
FIG. 8 is a diagram illustrating timings when the ejection failure state sensing process is carried out and in which the axis of abscissas indicates elapsed time.

The flow of control for the printing operation and ejection failure state sensing process according to the present embodiment will be described with reference to FIG. 8 and FIG. 9. FIG. 8 is a diagram illustrating timings at which the ejection failure state sensing process is carried out. FIG. 9 is a flowchart of a printing operation during which the ejection failure state sensing process according to the present embodiment is carried out. In FIG. 9, it is assumed that (n) pages of print media are printed and that the ejection failure state sensing process 7A for all the ejection ports is carried out every time (t) pages are printed.

The printing operation and ejection failure state sensing process according to the present embodiment are started (S201). Then, before the first page is printed, the second ejection failure state sensing process 7A is carried out on all the ejection ports to sense the ejection failure state (S301). Based on the sensing result, the process determines whether or not each of all the ejection ports is in the ejection failure state (S302). If any ejection port is in the ejection failure port, a flag is set (S303). If no ejection port is in the ejection failure state, the process shifts to the printing operation. Then, in the first printing operation, printing operation for one print medium is performed normally. At this time, if during the already carried-out ejection failure state sensing process 7A, any ejection port is found to be in the ejection failure state, then in addition to the normal printing operation, the ejection failure compensation printing is performed on the print medium (S213). Furthermore, if no ejection port is in the ejection failure state, the normal printing operation is performed (S203). When printing of one page is finished, the ejection failure state sensing process 7B is carried out concurrently with the inter-page processing as the first ejection failure state sensing process for only the small-diameter ejection ports (S204). In the present embodiment, every time printing of one page is finished, the ejection failure state sensing process 7B is carried out concurrently with the inter-page processing. The inter-page processing is between the step of feeding of roll paper and the step of returning of the roll paper shown in FIG. 2.

If during the ejection failure state sensing process 7B, any ejection port is sensed to be in the ejection failure state (S205), a flag is set (S206). If during the ejection failure state sensing process 7B, no ejection port is sensed to be in the ejection failure state, the flag is not set and the flow progresses without any interruption. In S207, the process checks whether or not all the pages have been printed.

If not all the pages have been printed, then in S209, the process checks whether or not printing of (t) pages has just been finished. If the current timing is not the one when printing of (t) pages has just been finished, the flow returns to S202. If the current timing is the one when printing of (t) pages has just been finished, the ejection failure state sensing process 7A is carried out on all the ejection ports (S210). If during the ejection failure state sensing process 7A, any ejection port is sensed to be in the ejection failure state (S211), the flag is set (S212). If during the ejection failure state sensing process 7A, no ejection port is sensed to be in the ejection failure state, the flag is not set, and the flow progresses without any interruption.

Upon returning to S202, the process checks whether or not the flag has been set. If process determines that the flag has been set and thus that any ejection port is in the ejection failure state, then in addition to the normal printing operation for one print medium, the ejection failure compensation printing is performed (S213). When the normal printing operation and the ejection failure compensation printing are performed in S213, the flag is cleared. Thereafter, in S204, the ejection failure state sensing process 7B for the small-diameter ejection ports is carried out. Then, similarly, if during the ejection failure state sensing process 7B, any ejection port is sensed to be in the ejection failure state, then in S206, the flag is set, and the flow advances to S207. If no ejection port is sensed to be in the ejection failure state, the flow progresses without any interruption. Then, in S207, the process checks whether or not (n) pages of print media have been printed. The flow is repeatedly carried out on all of the (n) pages. When printing of (n) pages is finished, the printing operation and ejection failure state sensing process according to the present embodiment are completed (S208). As shown in FIG. 8, in the present embodiment, the ejection failure state sensing process 7A for all the ejection ports is carried out during the continuous printing operation for 10 pages. During the continuous printing operation, the ejection failure state sensing process 7B is carried out every time one page is printed.

As described above, the sensing process is focused on the ejection ports which have the smallest diameter so as to prevent the image quality from being degraded by the ejection failure state of the ejection ports which have the smallest diameter in the plural types of the ejection ports. This is because the ejection failure state is relatively likely to occur at the ejection ports which have the smallest diameter in the plural types of the ejection ports. The present embodiment thus enables the ejection ports in which the ejection failure state is likely to occur to be frequently sensed whether or not the ejection ports is in the ejection failure state, reliably. At the same time, by using the minimum ejection failure state sensing process, the present embodiment enables the quality of print images to be kept high, while allowing a decrease in throughput to be suppressed.

Figure 10:
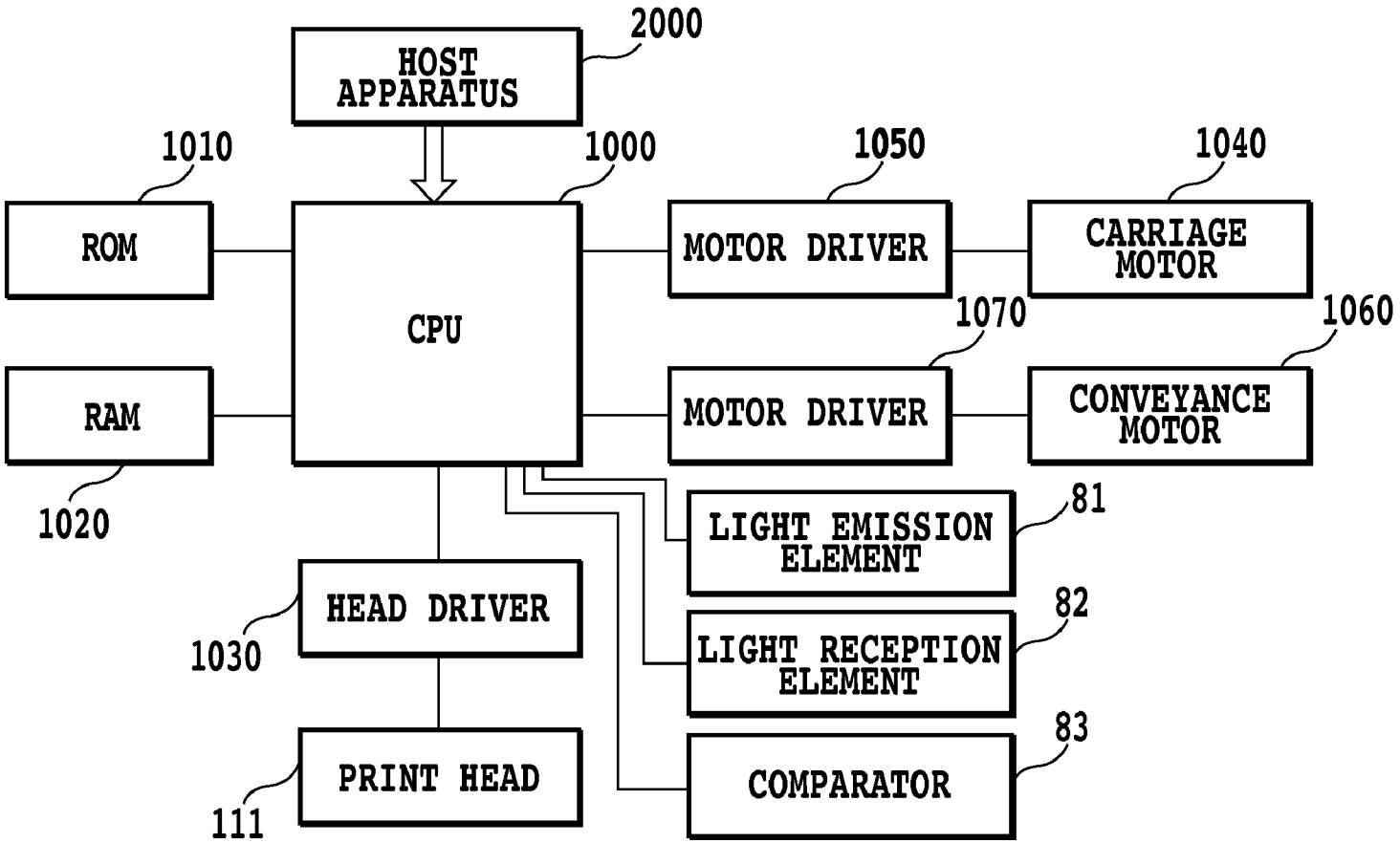
FIG. 10 is a block diagram of the configuration of a control system for the printing apparatus in FIG. 1.

FIG. 10 is a block diagram of a control system of the ink jet printing apparatus according to the present embodiment. A CPU 1000 executes control processing for various operations, data processing, and the like in accordance with inputs from a host apparatus 2000. A ROM 1010 is configured to store programs for process procedures for the above-described processing and the like. Furthermore, a RAM 1020 is used as a work area in which the processing is executed. The print head 111 is allowed to eject ink by the CPU 1000 supplying a head driver 1030 with driving data (image data) for the electrothermal conversion units and driving control signals (heat pulse signals). The CPU 1000 controls, via a motor driver 1050, a carriage motor 1040 configured to drive the carriage in the main scanning direction, and controls, via a motor driver 1070, a conveyance motor 1060 configured to convey print media.

Furthermore, the CPU 1000 allows the light emission element 81 to emit light during the ejection failure state sensing process for the ejection ports. For the ejection failure state sensing process 7B for the relatively-small-diameter ejection ports, the CPU 1000 allows the light emission element 81 to emit light only to the positions corresponding to the relatively-small-diameter ejection ports. For the ejection failure state sensing process 7A for all the ejection ports, the CPU 1000 allows the light emission element 81 to emit light to the positions corresponding to all the ejection ports. Then, the CPU 1000 senses the quantity of light reaching the light reception element 82 via an area through which ink droplets pass. At this time, the quantity of light received by the light reception element and the quantity of light received by the light reception element during normal ink ejections are compared with each other. For the comparison, the quantity of light received during normal ejections, which quantity is stored in the storage area such as the ROM 1010 or the RAM 1020, is read. Then, the quantity of light received which is detected during the ejection failure state sensing process and the quantity of light received during normal ejections are compared with each other. In this case, a voltage value obtained from the quantity of light received by the light reception element and a voltage value Vref as a reference obtained by the light reception element during normal ink ejections are compared with each other by using the comparator 83.

When any ejection port is sensed to be in the ejection failure state, the CPU 1000 allows, via the head driver 1030, the print head to perform the ejection failure compensation printing operation in addition to the normal printing operation. Thus, in the present embodiment, the CPU 1000 functions as first ejection failure state sensing unit for carrying out the first ejection failure state sensing process 7B of sensing the ejection state of the ink droplet ejected through which the relatively-small-diameter ejection ports. Furthermore, the CPU 1000 functions as second ejection failure state sensing unit for carrying out the second ejection failure state sensing process 7A of sensing the ejection state of the ink droplet ejected from all the ejection ports.

The following experiments were carried out to verify the effects of the present invention. In the experiments, first, one-way, 2-pass printing is performed using all of 5-pl ejection ports. A solid image is printed on 10 A4-sized sheets at a duty of 152%. Then, continuous 2-pass printing is performed using all of cyan and magenta 1-pl ejection ports. A solid image is printed on A4-sized sheets at a duty of 152%. The resulting images are then observed to check whether or not the ejection failure state is occurring. In these experiments, the printing conditions are the 2-pass printing, that is, relatively few passes printing. The printing conditions are a duty of 152%, that is, relatively high duty printing.

The first operation of printing a solid image on 10 sheets using the 5-pl ejection ports is to create an environment for continuous use. As printing is performed by such printing conditions, printing can be performed under printing condition being similar to continuous and severe printing condition performed by printing apparatuses for industrial applications or the like. Thus, in the 1-pl ejection ports, printing is performed under printing conditions in which the ejection failure state is more likely to occur than in the 5-pl ejection ports.

When the 5-pl ejection ports were used, no white stripes resulting from ejection failures were observed. In the experiments, in the printing apparatus according to the present embodiment, the ejection failure state was sensed for all the 1-pl ejection ports (a total of 512 nozzles) for each page. The ejection failure compensation printing was performed on an area corresponding to an ejection port determined to be in the ejection failure state. In contrast, in the comparative example, neither the sensing of the ejection failure state nor the ejection failure compensation printing was carried out.

About 10 verifications were carried out under the above-described conditions. In the comparative example, several white stripes seemingly resulting from ejection failures started to be observed on the fourth or fifth printed sheet. In contrast, in the embodiment, almost no white stripe was observed even on the 10th printed sheet. In the experiments, the time required to sense the ejection failure state for only the small-diameter ejection ports was 5 seconds for each page. The time required to sense the ejection failure state for all the ejection ports was 15 seconds for each page.

As a result, the ejection failure state was not observed in the ejection ports with an ejection amount of equal to or more than 5 pl. However, the results for the comparative example indicate that the ejection failure state occurs in the 1-pl ejection ports, leading to degradation of quality of print images. However, the printing apparatus according to the present embodiment frequently carries out sensing of the ejection failure state for the 1-pl ejection ports. Thus, if any ejection port is sensed to be in the ejection failure state, the ejection port in the ejection failure state can be recognized relatively early. Furthermore, even if the ejection failure state occurs in any ejection port, the ejection failure compensation printing is performed relatively early. Thus, the ejection port in the ejection failure state is compensated relatively early. Thus, in the printing apparatus according to the present embodiment, the quality of print images is prevented from being degraded as a result of the experiments.

Furthermore, sensing of the ejection failure state is frequently carried out on the small-opening-area ejection ports and the small ejection amount and is less frequently carried out on the ejection ports with the large opening area. In the present experiments, sensing of the ejection failure state was not carried out on the large-opening-area ejection ports. In this manner, sensing of the ejection failure state is carried out in accordance with the likelihood of occurrence of the ejection failure state. Hence, the processing can be accomplished with a prominent decrease in throughput prevented.

The first ejection failure state sensing process 7B need not necessarily be carried out while inter-page processing is being executed. For example, as disclosed in Japanese Patent No. 3382526, the first ejection failure state sensing process 7B may be carried out during the time between each scanning operations of the carriage while the print head 111 is not scanning.

Second Embodiment

Figure 11:
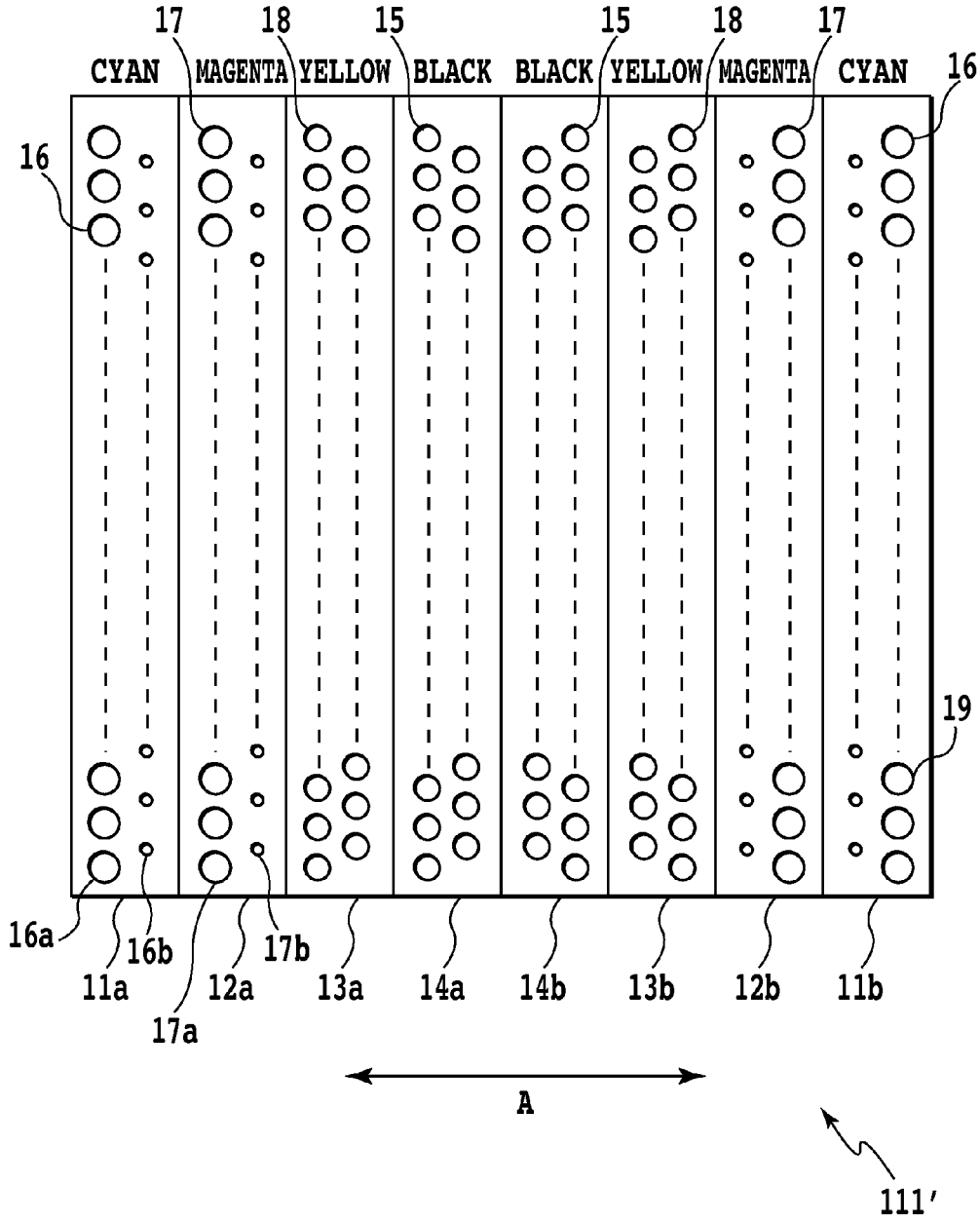
FIG. 11 is an enlarged plan view showing an ejection port formation surface of a print head mounted in a printing apparatus according to a second embodiment of the present invention.

Now, a second embodiment will be described with reference to FIG. 11. Components of the second embodiment which are configured similarly to the corresponding ones of the first embodiment are denoted by the same reference numerals and will not be described below. Only differences from the first embodiment will be described. FIG. 11 shows a plan view of an ejection port formation surface of a print head according to the second embodiment.

According to the above-described first embodiment, in the ejection ports in the print head 111 used in the printing apparatus, for each of the black ink and the yellow ink, one ejection port row is formed. For each of the cyan ink and the magenta ink, two ejection port rows are formed. Thus, the ejection port rows formed in the print head are not symmetric. Hence, while the print head 111 is scanning, the color impression may vary between the forward scanning direction and the backward scanning direction. Therefore, the print head 111 is not adapted for two-way printing. In contrast, a print head 111' according to the second embodiment is different from the print head 111 according to the first embodiment in that in the second embodiment, the ejection port rows are symmetric.

Ejection port rows through which black ink, cyan ink, magenta ink, and yellow ink are ejected are formed in the print head 111' in the ink jet printing apparatus according to the second embodiment. In the present embodiment, two black heads 14*a* and 14*b* configured to eject black ink are formed in a central portion of the print head. Yellow heads 13*a* and 13*b* configured to eject yellow ink are formed outside both the black heads 14*a* and 14*b* so as to sandwich both the black heads 14*a* and 14*b* between the yellow heads 13*a* and 13*b*. Furthermore, magenta heads 12*a* and 12*b* are formed outside the yellow heads 13*a* and 13*b*. Cyan heads 11*a* and 11*b* are formed outside the magenta heads 12*a* and 12*b*.

Ejection ports 15 through which black ink is ejected and ejection ports 18 through which yellow ink is ejected are all formed to have such a diameter as serves to provide an ink ejection amount of 5 pl. Furthermore, ejection ports 16 through which cyan ink is ejected include ejection ports 16*a* with such a diameter as serves to provide an ink ejection amount of 5 pl and ejection ports 16*b* with such a diameter as serves to provide an ink ejection amount of 1 pl. Ejection ports 17 through which magenta ink is ejected include ejection ports 17*a* with such a diameter as serves to provide an ink ejection amount of 5 pl and ejection ports 17*b* with such a diameter as serves to provide an ink ejection amount of 1 pl. In order to be symmetric, the print head 111' according to the present embodiment includes an ejection port row formed inside and in which the ejection ports 16*b*, 17*b* with an ejection amount of 1 pl are arranged and an ejection port row formed outside and in which the ejection ports 16*a*, 17*a* with an ejection amount of 5 pl are arranged. Additionally, the two ejection port rows for each color are such that one of the ejection port rows is staggered with respect to the other ejection port row by half a pitch.

For the ejection ports 15 through which the black ink is ejected and the ejection ports 18 through which the yellow ink is ejected, 640 ejection ports are arranged at an arrangement density of about 245 nozzles per 1 cm. For the ejection ports 16 through which the cyan ink is ejected and the ejection ports 17 through which the magenta ink is ejected, 2,560 ejection ports are arranged at an arrangement density of about 980 nozzles per 1 cm. In the present embodiment, of the 5,120 cyan and magenta nozzles, 2,560 nozzles which is an ejection amount of 1 pl are formed.

As shown in FIG. 11, in the print head, the ejection port rows are arranged symmetrically with respect to a main scanning direction A. Thus, the order of ink colors ejected in the forward scanning direction of the print head is the same as the order of ink colors ejected in the backward scanning direction of the print head. This reduces the adverse effect of the moving direction of the print head on images. Thus, the present embodiment is suitable for two-way printing in which printing is performed in both the forward and backward scanning directions. The application of two-way printing serves to make the printing speed higher than that of the print head according to the first embodiment. Therefore, the print head according to the present embodiment is suitable for printing of large-sized sheets such as A3-sized sheets.

As described above, according to the present embodiment, if a print head with ejection port rows symmetrically arranged therein is adopted in order to increase the printing speed, the ejection failure state sensing process can be reliably accomplished without a decrease in printing throughput. Thus, even if the printing speed is increased to reduce the time required for printing, sensing of the ejection failure state is prevented from requiring an unnecessarily long time. This enables a reduction in printing time.

Third Embodiment

Now, an ink jet printing apparatus according to a third embodiment will be described. Components of the third embodiment which are configured similarly to the corresponding ones of the first or second embodiment are denoted by the same reference numerals and will not be described below. Only differences from the first and second embodiments will be described.

In the above-described first and second embodiments, when printing of each page is finished, the ejection failure state sensing process for the ejection ports is carried out concurrently with the inter-page processing. The time required for the ejection failure state sensing process for the ejection ports varies depending on conditions such as the number of ejection ports formed in the print head. The time required for the ejection failure state sensing process increases consistently with the number of ejection ports formed in the print head. If this amount of time exceeds the time required for the inter-page processing, the need to wait for the ejection failure state sensing process to be finished arises. Furthermore, this wait time tends to further increase consistently with the number of ejection ports, in order to deal with increased printing definition.

Figure 12:
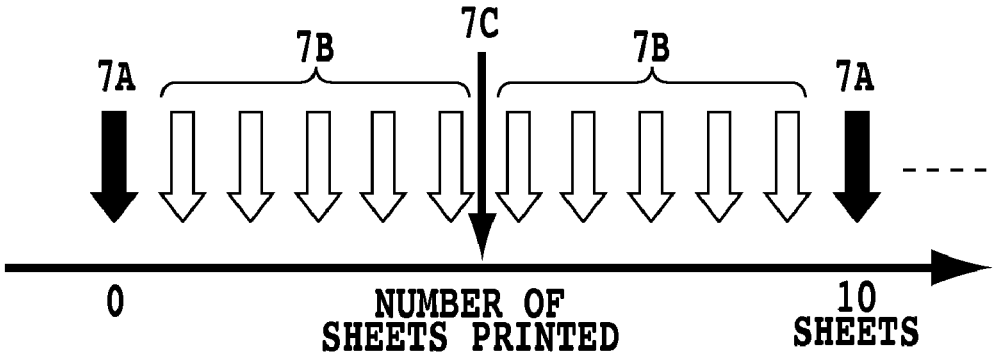
FIG. 12 is a diagram illustrating timings when the ejection failure state sensing process is carried out by a printing apparatus according to a third embodiment of the present invention.

Thus, in order to further improve the throughput, the third embodiment caries out an ejection failure state sensing process 7B, that is, a first ejection failure state sensing process for each page, only on particular ones of the small-diameter ejection ports. In the present embodiment, particular ejection ports of the ejection ports of the small-diameter are the ejection ports through which the particular color ink is ejected. In the present embodiment, the first ejection failure state sensing process for each page is executed for the ejection ports of the small-diameter through which the particular color ink is ejected. For example, if the ejection failure state is likely to occur in ejection ports 16 through which cyan ink is ejected, then the first ejection failure state sensing process 7B is carried out, for each page, only on those of the cyan ejection ports 16*b* which have a small diameter. A third ejection failure state sensing process 7C is carried out on those of the ejection ports for the other ink colors which have a small diameter, at a frequency different from that for the first ejection failure state sensing process 7B and a second ejection failure state sensing process 7A. In the present embodiment, when the second ejection failure state sensing process 7A is carried out and 5 pages are printed, the third ejection failure state sensing process 7C executed. FIG. 12 shows timings when the third ejection failure state sensing process 7C is carried out. In this manner, besides the first ejection failure state sensing process 7B and the second ejection failure state sensing process 7A, the third ejection failure state sensing process 7C may be carried out, the frequency of which is different from those of the first and second ejection failure state sensing processes 7B and 7A. In this case, a CPU 1000 functions as third ejection failure state sensing unit for carrying out the third ejection failure state sensing process 7C.

As described above, in the third embodiment, when printing of each page is finished, the first ejection failure state sensing process 7B is carried out only on the ejection ports having a relatively small diameter and through which droplets in a color of which the ejection failure state is likely to occur are ejected. Then, when the printing for the predetermined sheets is finished, the second ejection failure state sensing process 7A is carried out on all the ejection ports at a frequency lower than that for the first ejection failure state sensing process 7B. Furthermore, the third ejection failure state sensing process 7C is carried out on the ejection ports having a relatively small diameter and on which the first ejection failure state sensing process has not been carried out, at a frequency different from those for the first and second ejection failure state sensing processes and at predetermined timings. Executing the ejection failure state sensing processes as described above enables a reduction in the wait time resulting from the first ejection failure state sensing process 7B while inhibiting the ejection failure state from occurring in the ejection ports.

Fourth Embodiment

Now, an ink jet printing apparatus according to a fourth embodiment will be described. Components of the fourth embodiment which are configured similarly to the corresponding ones of any of the first to third embodiments are denoted by the same reference numerals and will not be described below. Only differences from the first to third embodiments will be described.

In the third embodiment, the first ejection failure state sensing process is carried out on the particular small-diameter ejection ports, that is, the ejection ports having a relatively small diameter and through which ink in a particular color likely to be the ejection failure state is ejected. The third ejection failure state sensing process is carried out on the other relatively-small-diameter ejection ports. In contrast, in the fourth embodiment, a first ejection failure state sensing process 7B is carried out, for each page, on ejection ports having a small diameter and positioned in a particular area as a particular small diameter ejection ports. In the present embodiment, the particular area is the vicinity of the center of each ejection port row in which the ejection failure state is likely to occur. In the present embodiment, the first ejection failure state sensing process 7B is carried out at the ejection ports located in the vicinity of the center of each ejection port row, for each page. When a second ejection failure state sensing process 7A is carried out and 5 pages are printed, a third ejection failure state sensing process 7C is executed on the relatively-small-diameter ejection ports other than those on which the first ejection failure state sensing process 7B is selectively carried out. In the present embodiment, the first ejection failure state sensing process 7B is carried out, for each page, on 100 ejection ports having a small diameter and counted outward from the center of the ejection port row along the extending direction thereof. When the second ejection failure state sensing process 7A is carried out and 5 pages are printed, the third ejection failure state sensing process 7C is carried out on the other relatively-small-diameter ejection ports. The above-described particular color and the number of ejection ports counted from the center of the ejection port row are not limited to those described above and may be appropriately varied.

Fifth Embodiment

Now, an ink jet printing apparatus according to a fifth embodiment will be described. Components of the fifth embodiment which are configured similarly to the corresponding ones of any of the first to fourth embodiments are denoted by the same reference numerals and will not be described below. Only differences from the first to forth embodiments will be described.

The fifth embodiment is different from the first to forth embodiments in that the first ejection failure state sensing process 7B carried out on the small-diameter ejection ports is divided into a plurality of operations.

An increase in the number of small-diameter ejection ports correspondingly increases the time required for a first ejection failure state sensing process 7B. This in turn increases the time to wait for the first ejection failure state sensing process 7B to be finished, reducing the printing throughput. Thus, in the present embodiment, the first ejection failure state sensing process 7B is divided into a plurality of operations so that each of the operations can be finished within the time during which the inter-page processing is carried out.

In the present embodiment, the first ejection failure state sensing process 7B, carried out for each page, is executed only on some of the small-diameter ejection ports. The next first ejection failure state sensing process 7B is then carried out on the ejection ports on which the last first ejection failure state sensing process 7B has not been executed. In this manner, the ejection ports on which the ejection failure state sensing process is carried out in the first ejection failure state sensing process 7B are divided into groups. This reduces the number of ejection ports on which ejection failure state sensing process is carried out in a single first ejection failure state sensing process 7B. As a result, the time required for the ejection failure state sensing process 7B is shortened. In this case, if the time required for the ejection failure state sensing process 7B is shorter than the time required for the inter-page processing, no wait time is required. Even if any wait time is required, the decrease in the time required for the ejection failure state sensing process 7B serves to reduce the total time required for the printing operation and the ejection failure state sensing process. Thus, the printing throughput can be improved.

The "ink" or the "liquid" needs to be broadly interpreted and refers to a liquid applied onto a print medium to form an image, a pattern, or the like, process the print medium, or treat the ink or the print medium. Here, the treatment of the ink or the print medium refers to, for example, improvement of fixability of the ink resulting from solidification or insolubilization of a color material in the ink, improvement of print quality or coloring capability, or improvement of image durability. Furthermore, the term "printing" as used herein means not only application of a meaningful image such as characters or figures onto the print medium but also application of a meaningless image such as a pattern onto the print medium.

Furthermore, in the above-described embodiments, one page of print medium is formed by cutting roll paper into pieces each with a predetermined length. However, the print medium may be print sheets each preformed to have a predetermined size. In this case, the inter-page processing is between the step in which a printing onto a print medium is performed, then the printed print medium is conveyed, and the step in which the next print medium to be printed is placed in a print area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-148830, filed Jun. 23, 2009, which is hereby incorporated by reference herein in its entirety.

What is claimed is:

1. A printing apparatus configured with a mounted print head comprising ejection ports through which different amounts of ink in the same color are ejected, the ejection amounts being equal to or smaller than 5 pl, the print head ejecting ink for printing through the ejection ports, the printing apparatus comprising:

an ejection failure state sensing unit for carrying out first and second ejection failure state sensing processes, the first ejection failure state sensing process for sensing an ejection state of ink ejected through predetermined ejection ports which have ejection opening areas smaller than that of all other ejection ports formed in the print head, ink being ejected through the predetermined ejection ports without being ejected through the other ejection ports in the first ejection failure state sensing process, the second ejection failure state sensing process for sensing an ejection state of ink ejected through all the ejection ports formed in the print head, wherein the second ejection failure state sensing process is carried out less frequently than the first ejection failure state sensing process, and wherein when one of the ejection ports is determined to be in an inappropriate ejection state by the first ejection failure state sensing process or the second ejection failure state sensing process, compensation printing is carried out so as to compensate for dots to be formed by the one ejection port in the inappropriate ejection state using at least one different ejection port for printing with compensation.

2. The printing apparatus according to claim 1, wherein a print medium is printed by ejecting ink onto the print medium, and inter-page processing is carried out after each page is printed, and the first ejection failure state sensing process is carried out concurrently with the inter-page processing.

3. The printing apparatus according to claim 1, wherein the print head is capable of ejecting plural types of ink in respective colors, and the first ejection failure state sensing process is carried out on the ejection ports through which plural types of ink in color are ejected among the predetermined ejection ports.

4. The printing apparatus according to claim 1, wherein the first ejection failure state sensing process is carried out on the ejection ports which are formed at a position in a partial area of the predetermined ejection ports.

5. The printing apparatus according to claim 1, wherein the first ejection failure state sensing process is divided into a plurality of operations in such a manner that the plurality of operations covers all the predetermined ejection ports.

6. The printing apparatus according to claim 1, wherein the first ejection failure state sensing process is carried out on a portion of the predetermined ejection ports, and the ejection failure state sensing unit carries out a third ejection failure state sensing process on the ejection ports on which the first ejection failure state sensing process has not been carried out among the predetermined ejection ports, the third ejection failure state sensing process being carried out at a frequency different from a frequency of the first ejection failure state sensing process and a frequency of the second ejection failure state sensing process.

7. The printing apparatus according to claim 1, wherein the print head performs printing by ejecting ink through the ejection ports while scanning in a direction orthogonal to a direction in which a print medium is conveyed, and the first ejection failure state sensing process is carried out during an interval between scannings.

8. A printing method of performing printing using a printing apparatus configured to perform printing by allowing a print head including ejection ports to eject different amounts of ink in the same color through the ejection ports, the ejection amounts being equal to or smaller than 5 pl, the printing method comprising:

a first ejection failure state sensing step of sensing an ejection state of ink ejected through predetermined ejection ports which have ejection opening areas smaller than that of all other ejection ports formed in the print head, ink being ejected through the predetermined ejection ports without being ejected through the other ejection ports in the first ejection failure state sensing step; and a second ejection failure state sensing step of sensing an ejection state of ink ejected through all the ejection ports formed in the print head, wherein the second ejection failure state sensing step is carried out less frequently than the first ejection failure state sensing step, and wherein when one of the ejection ports is determined to be in an inappropriate ejection state by the first ejection failure state sensing step or the second ejection failure state sensing step, compensation printing step is carried out so as to compensate for dots to be formed by the one ejection port in the inappropriate ejection state using at least one different ejection port.

* * * * *